US005342269A

United States Patent [19]

Huang et al.

[11] Patent Number: 5,342,269

[45] Date of Patent: Aug. 30, 1994

[54] ARM OSCILLATING EXERCISER

[76] Inventors: Richard Huang; Lien F. Lin, both of P.O. Box 82-144, Taiwan, Taiwan

[21] Appl. No.: 177,753

[22] Filed: Jan. 4, 1994

[51] Int. Cl.[5] ..... A63B 21/04

[52] U.S. Cl. ..... 482/95; 482/130; 482/96; 482/137

[58] Field of Search ..... 482/130, 133, 135, 136, 482/137, 95, 96

[56] References Cited

U.S. PATENT DOCUMENTS

| | | | |
|---|---|---|---|
| 2,173,691 | 9/1939 | Marlowe | 482/130 |
| 2,642,288 | 6/1953 | Bell | 482/96 |
| 3,446,503 | 5/1969 | Lawton | 482/96 |
| 4,300,760 | 11/1981 | Bobroff | 482/96 |
| 4,743,010 | 5/1988 | Cieraci | 482/95 |
| 4,790,530 | 12/1988 | Maag | 482/137 |
| 5,156,650 | 10/1992 | Bacs | 482/95 |
| 5,178,599 | 1/1993 | Scott | 482/96 |

*Primary Examiner*—Robert Bahr

*Assistant Examiner*—Lynne A. Reichard

*Attorney, Agent, or Firm*—Alfred Lei

[57] ABSTRACT

An arm oscillating exerciser including a base provided with a first pair of lugs and a second pair of lugs, a pole fixedly mounted on the base and having an inclined top, a main support fixedly mounted on the base and formed with a fork-like member at the top end and a slot at the intermediate portion, an oscillating rod pivotally connected with the fork-like member of the main support, an axle inserted through the lower portion of the main support and provided with a pedal at both ends, a front supporting rod pivotally connected with a seat at one end and pivotally connected with the first pair of lugs of the base, a real supporting rod pivotally connected with the seat at one end and pivotally connected with the second pair of lugs of the base, and a linking rod pivotally connected with the front supporting rod at one end and pivotally connected with the oscillating rod at another end, whereby the exerciser can provide a total body workout in one continuous action.

2 Claims, 7 Drawing Sheets

ARM OSCILLATING EXERCISER

BACKGROUND OF THE INVENTION

It has been found that using the prior art exercising machine will not immediately benefit both the musculature and cardiovascular systems. Hence, how to keep the interest of the user becomes the most important goal for the exercising machines, but none of the exercising machines sold in the marketplace can fulfill this need.

Further, the prior art exercising machine is too monotonous to keep the interest of a user thereby making it infeasible for practical use.

Therefore, it is an object of the present invention to provide an arm oscillating exerciser which may obviate and mitigate the above-mentioned drawbacks.

SUMMARY OF THE INVENTION

This invention relates to an arm oscillating exerciser.

It is the primary object of the present invention to provide an arm oscillating exerciser which may provide a total body workout in one continuous action.

It is another object of the present invention to provide an arm oscillating exerciser which may provide both aerobic and anaerobic exercise.

It is still another object of the present invention to provide an arm oscillating exerciser which may develop all major muscle groups, including back, stomach, arms, shoulders, and legs.

It is still another object of the present invention to provide an arm oscillating exerciser which is simple in construction.

Other objects and merits and a fuller understanding of the present invention will be obtained by those having ordinary skill in the art when the following detailed description of the preferred embodiment is read in conjunction with the accompanying drawings wherein like numerals refer to like or similar parts.

DETAILED DESCRIPTION OF THE PREFERRED EMBODIMENT

Figure 1:
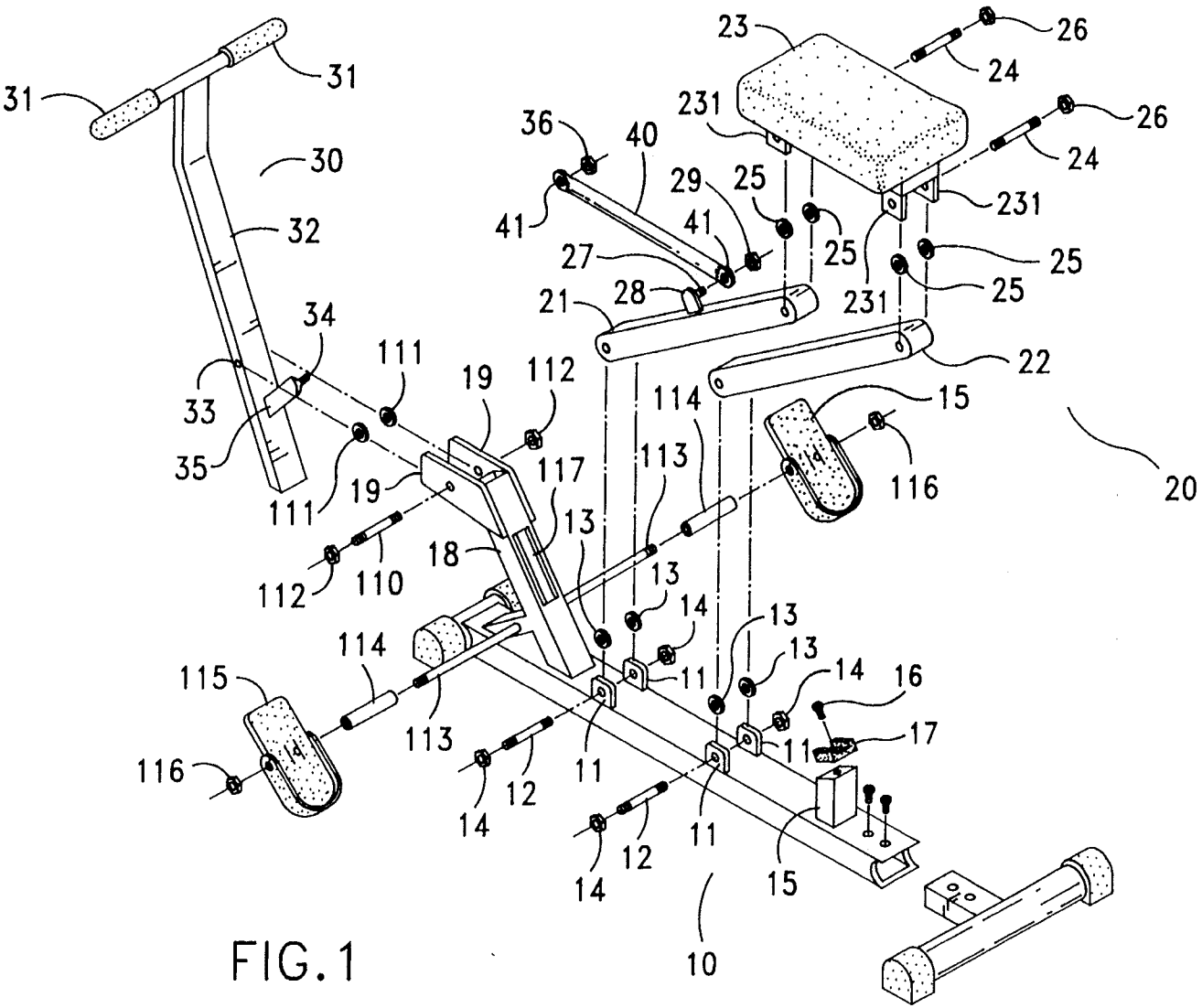
FIG. 1 is an exploded view of the present invention.

For purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
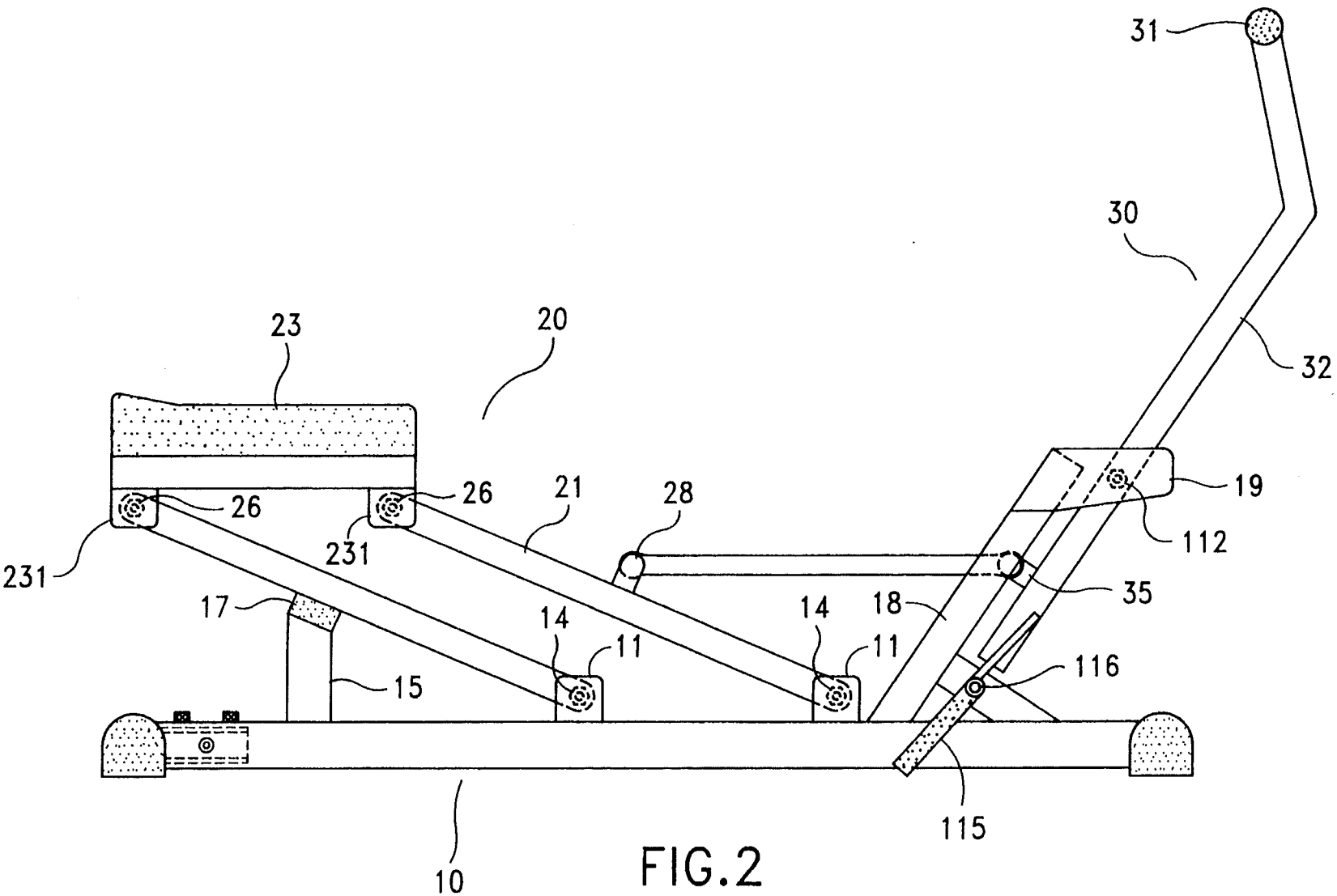
FIG. 2 is a side elevational view of the present invention.
Figure 3:
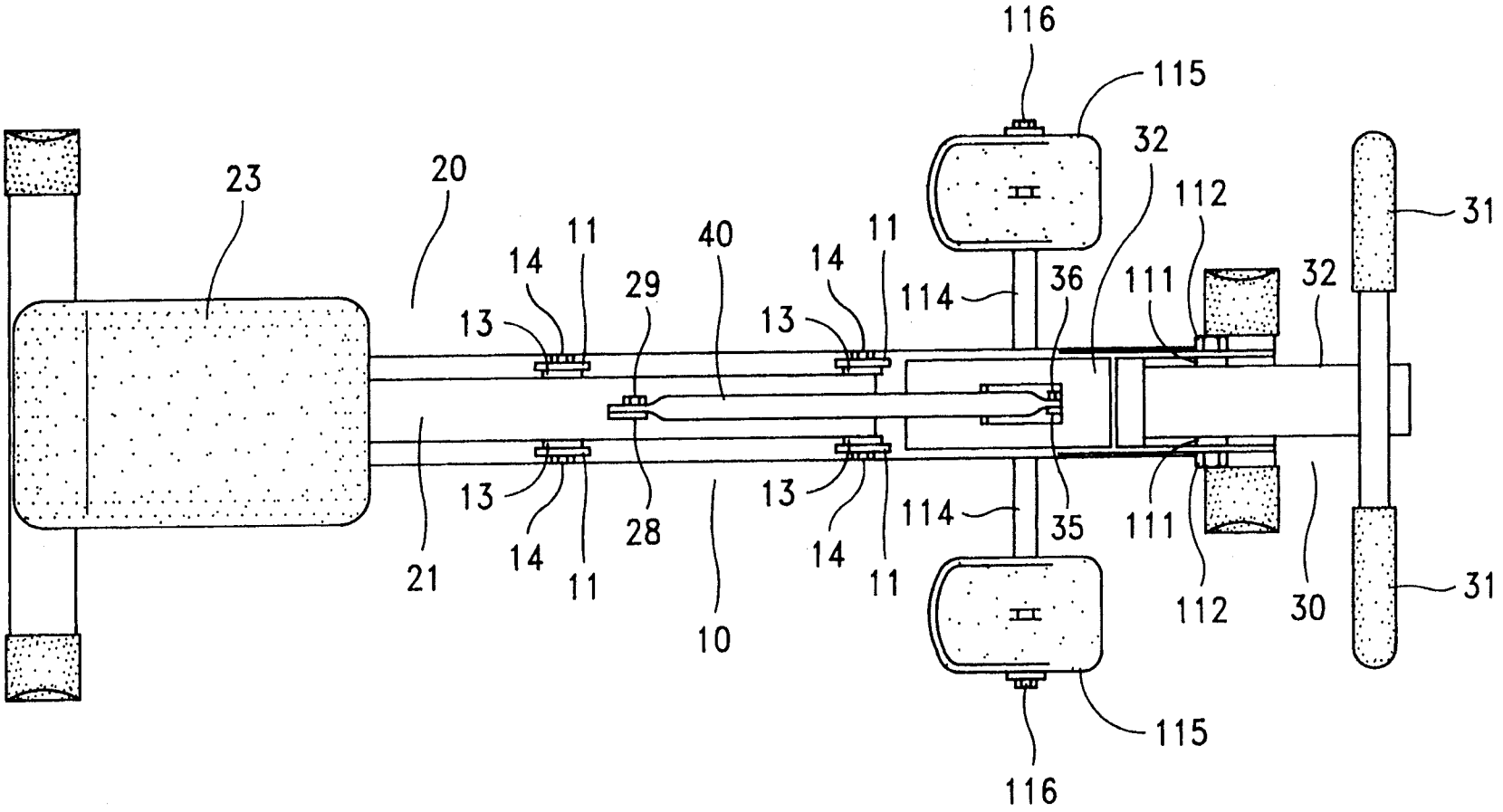
FIG. 3 is a top plan view of the present invention.

With reference to the drawings and in particular to FIGS. 1 and 2 thereof, the arm oscillating exerciser according to the present invention mainly comprises a base 10, a supporting mechanism 20, an oscillating rod 30, and a linking rod 40.

The base 10 is a H-shaped member provided with a first pair of lugs 11 and a second pair of lugs 11. A front supporting rod 21 and a rear supporting rod 22 are pivotally mounted on the first pair of lugs 11 and the second pair of lugs 11 by a pin 12, a pair of packings 13 and a pair of nuts 14, respectively. The right end (with respect to FIG. 1) of the base 10 is provided with a pole 15 having an inclined top on which is fixedly mounted a rubber member 17 by a screw 16 for supporting the rear supporting rod 22. A main support 18 is fixedly mounted on the front portion of the base 10, which is formed with a fork-like top end 19 engaged with the oscillating rod 30 by a pin 110, a pair of packings 111, and a pair of nuts 112. An elongated axle 113 extends through the lower portion of the main support 18 and has both ends connected with a sleeve 114 and a pedal 115 by a nut 116. Further, the main support 18 is formed with a slot 117 at its intermediate portion.

The supporting mechanism 20 includes the front supporting rod 21, the rear supporting rod 22, and a seat. The front supporting rod 21 and the rear supporting rod 22 are pivotally connected with the first pair of lugs and the second pair of lugs 11 at the lower end and pivotally connected with a first pair of lugs 231 and a second pair of lugs 231 of the seat 23 by a pin 24, a pair of packings 24 and a pair of nuts 26. The front supporting rod 21 is provided with a lug 28 having a threaded pin 27 engaged with an end of the linking rod 40 by a nut 29.

The oscillating rod 30 is a T-shaped member provided with a handle 31 at the top thereof and has a lever 32 which is formed with a hole 33. The fork-like top end 19 of the main support 18 is engaged with the oscillating rod 30 is engaged with the oscillating rod 30 by inserting a pin 110 into the fork-like top end 19 of the main support 18 and the hole 33 of the oscillating rod 30. Both ends of the linking rod 40 are formed with a hole 41. The linking rod 40 is pivotally connected with the lug 28 of the front supporting rod 21 at one end and with the threaded rod 34 of the lug 35 of the oscillating rod 30 through the slot 117 of the main support 18 at another end.

Figure 4:
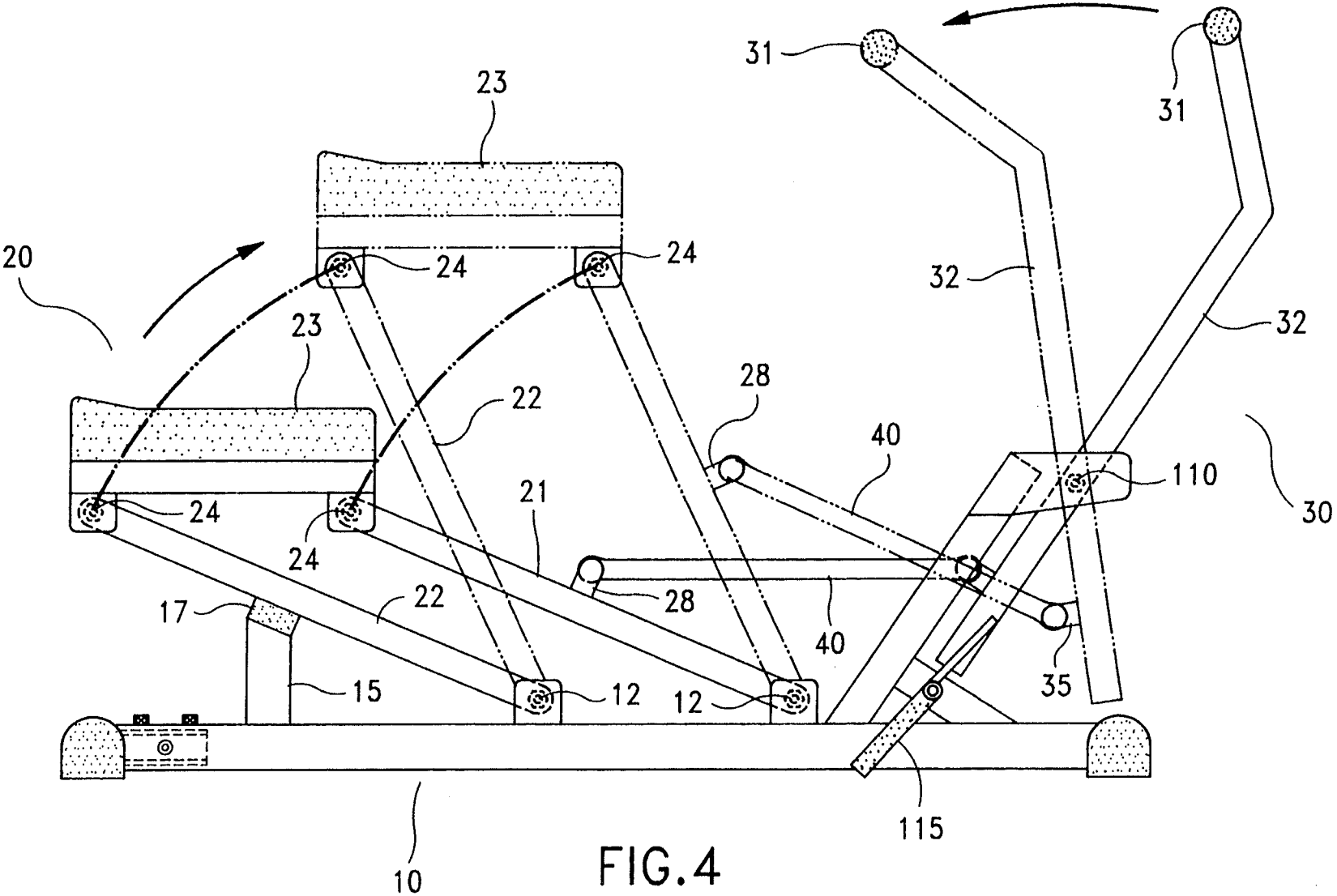
FIG. 4 shows how the present invention works.
Figure 5:
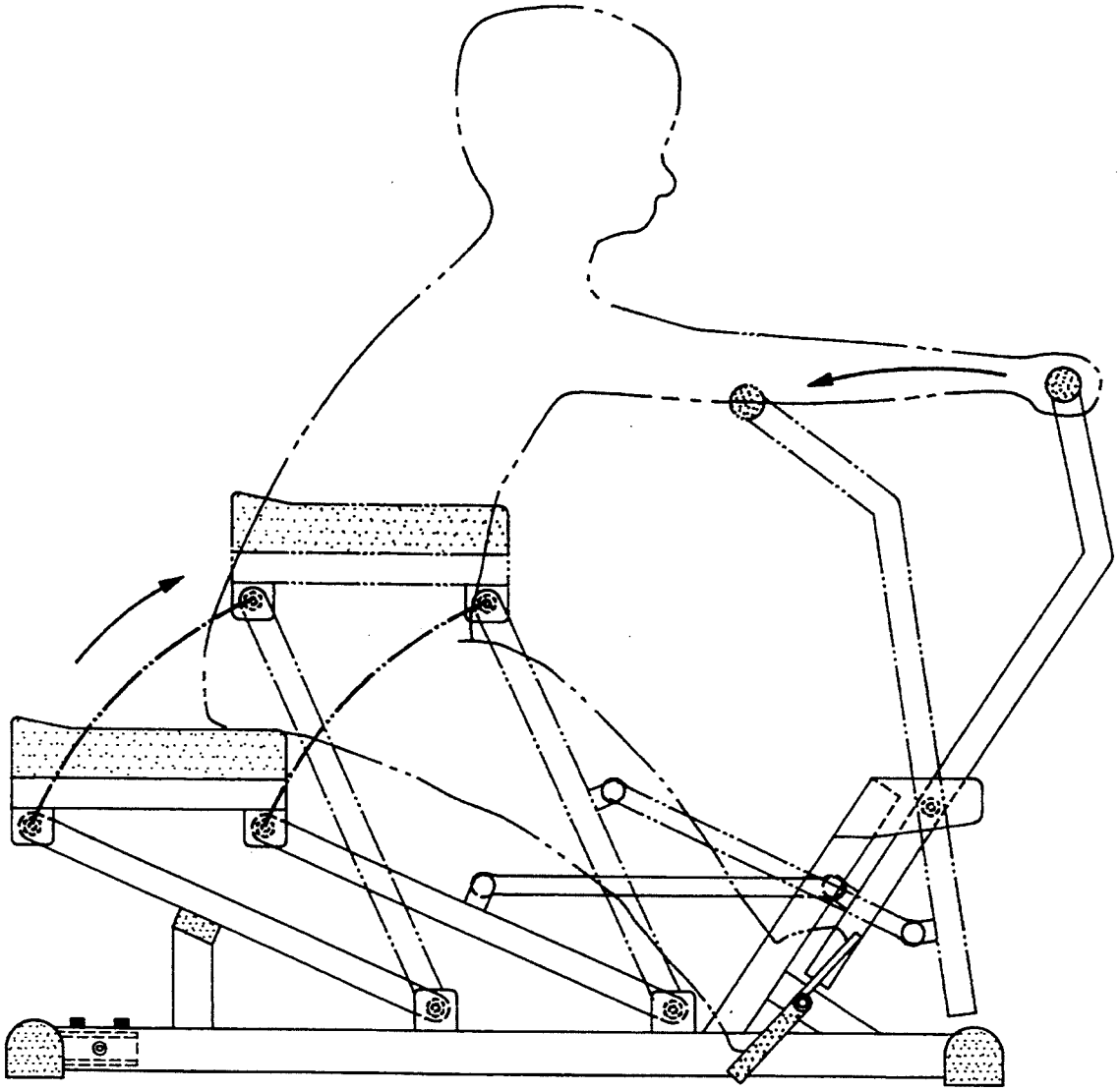
FIG. 5 is a working view of the present invention.

As shown in FIGS. 4 and 5, when the handle 31 is pulled to the left (with respect to FIG. 4), the pole 32 will pull the linking rod 40 to the right (with respect to FIG. 4). In the meantime, the linking rod 40 will pull the front supporting rod 21 to the right thereby raising the seat 23. Hence, when the oscillating rod 30 is moved forwards and backwards, the seat 23 will automatically go up and down thereby providing a total body workout in one continuous action.

Figure 6:
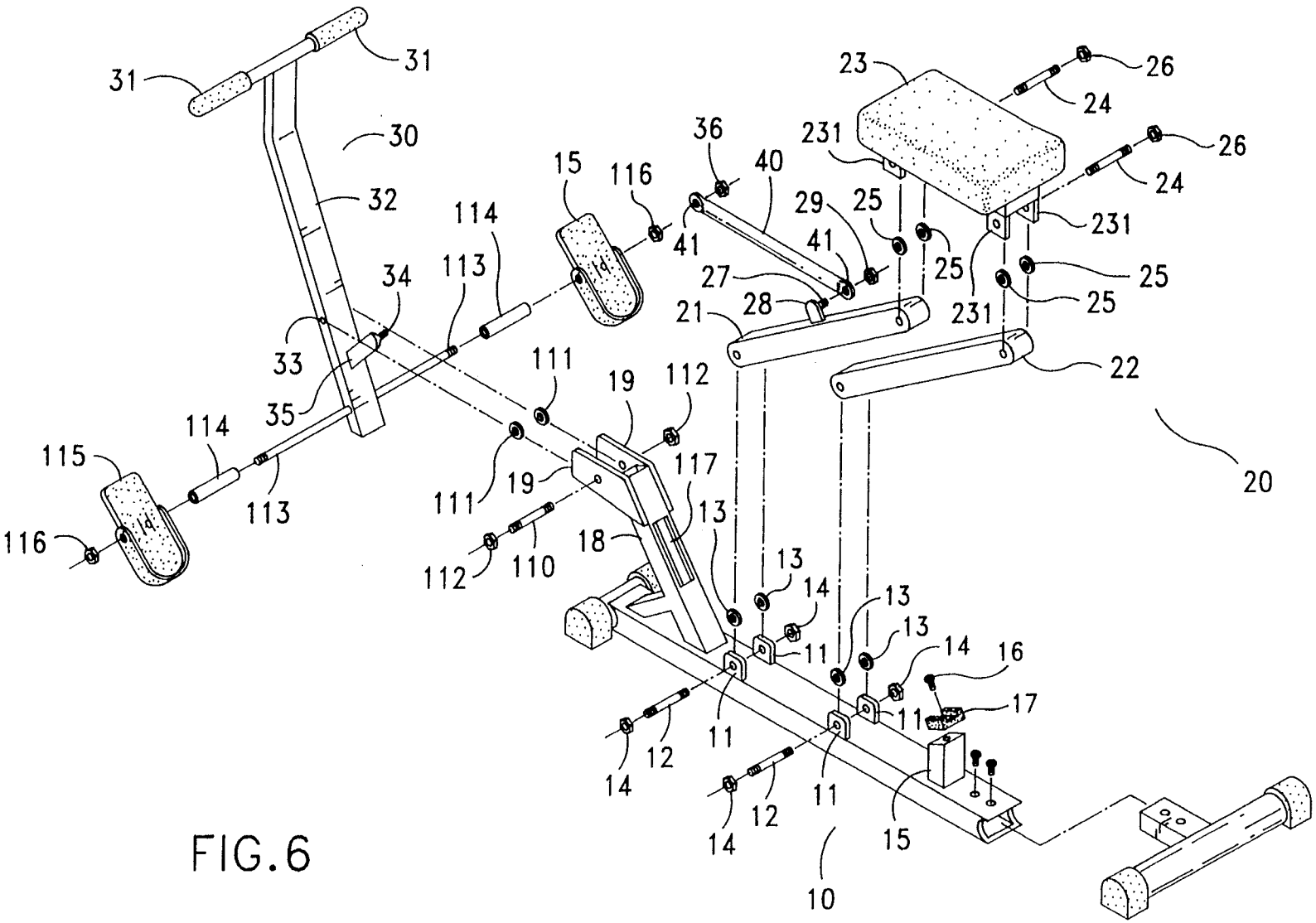
FIG. 6 is an exploded view of a second preferred embodiment according to the present invention.
Figure 7:
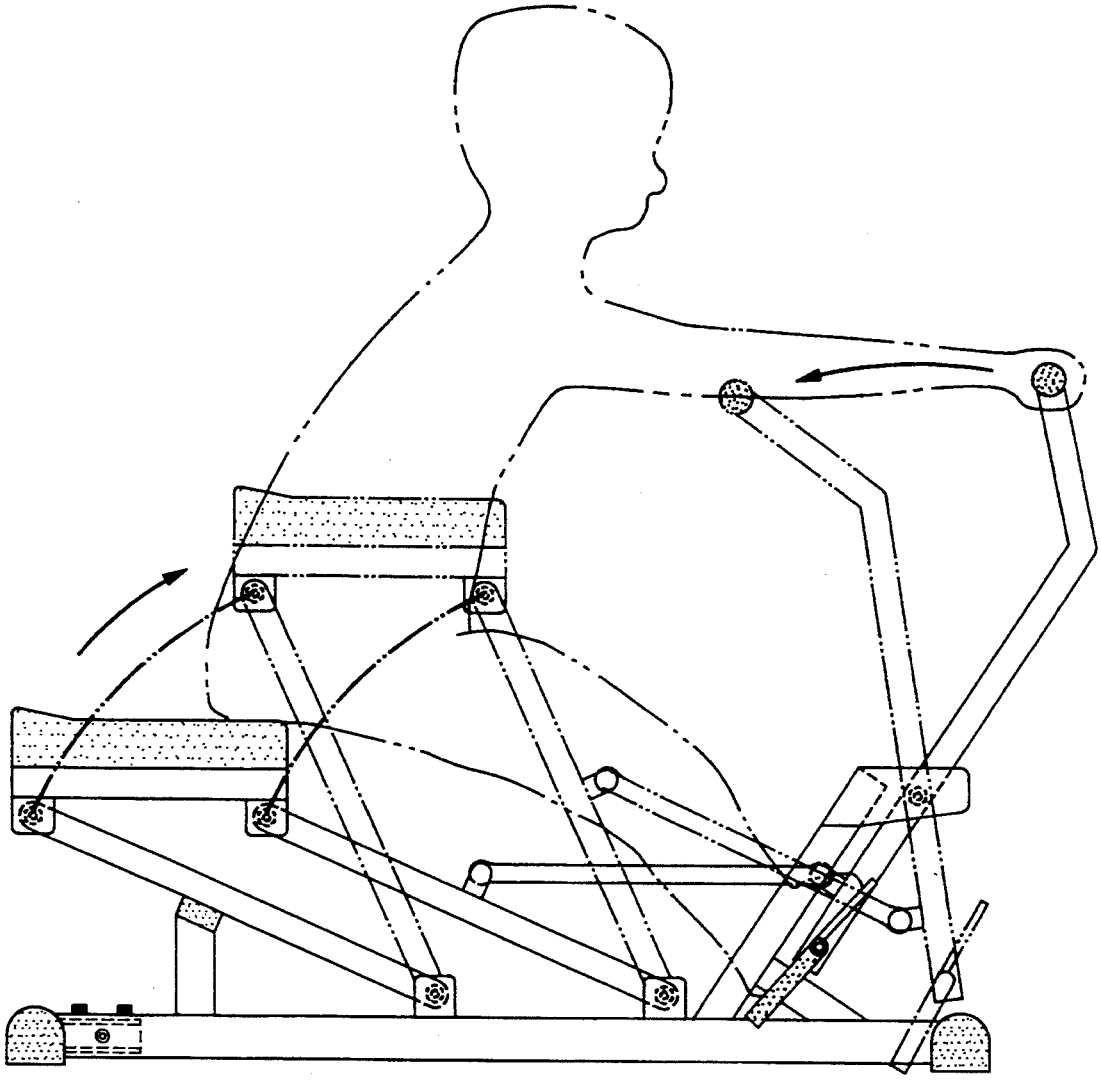
FIG. 7 is a working view of the second preferred embodiment according to the present invention.

FIG. 6 shows an exploded view of a second preferred embodiment according to the present invention. As illustrated, the elongated axle 113 extends through the lower portion of the lever 32 instead of the main support 18 and has its both ends connected with a sleeve 114 and a pedal 115 by a nut 116. FIG. 7 shows how the second preferred embodiment works.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. An arm oscillating exerciser comprising:

a base provided with a first pair of lugs and a second pair of lugs;

a pole fixedly mounted on said base and having an inclined top;

a main support fixedly mounted on said base and formed with a fork-like member at the top end and a slot at the intermediate portion;

an oscillating rod pivotally connected with the fork-like member of said main support;

an elongated axle inserted through the lower portion of said main support and provided with a pedal at both ends;

a front supporting rod pivotally connected with a seat at one end and pivotally connected with the first pair of lugs of said base;

a rear supporting rod pivotally connected with said seat at one end and pivotally connected with the second pair of lugs of said base; and a linking rod pivotally connected with said front supporting rod at one end and pivotally connected with said oscillating rod at another end.

2. The arm oscillating exerciser as claimed in claim 1, wherein said pole is provided with a rubber member on the inclined top.

* * * * *